US005395116A

United States Patent [19]

Blaakman

[11] Patent Number: 5,395,116

[45] Date of Patent: Mar. 7, 1995

[54] GOLF TIMER CONTROL

[76] Inventor: Frank L. Blaakman, 132 Cloverland Dr., Rochester, N.Y. 14610

[21] Appl. No.: 179,266

[22] Filed: Jan. 10, 1994

[51] Int. Cl.[6] ..... A63B 69/36

[52] U.S. Cl. ..... 273/184 R; 273/186.2

[58] Field of Search ..... 273/184 R, 186.2, 187.2, 273/183.1, 187.5, 190 R, 187.6, 187.4; 434/252

[56] References Cited

U.S. PATENT DOCUMENTS

| | | | |
|---|---|---|---|
| 4,560,166 | 12/1985 | Emerson | 273/187.2 |
| 4,898,389 | 2/1990 | Plutt | 273/186.2 |
| 4,991,850 | 2/1991 | Wilhlem | 273/186.2 |
| 5,303,924 | 4/1994 | Kluttz et al. | 273/184 R X |

*Primary Examiner*—George J. Marlo

[57] ABSTRACT

A new and improved golfing aid to emit an audible signal to a golfer at a predetermined lapsed time after hitting a golf ball comprising, a microphone located at the butt end of a golf club grip, the microphone adapted to detect the sound of a golf club hitting a golf ball and to generate a signal in response thereto; a microprocessor positioned in the grip of a golf club at the end thereof remote from the butt and microphone, the microprocessor having an emitter for an audible sound, the emitter adapted to be energized at a predetermined lapsed time following the detection of the signal by the microphone; control means within the microprocessor to vary the predetermined lapsed time at the selection of the user and to display the preselected lapsed time; and lines coupling the microphone and microprocessor for transmitting the signal generated by the microphone to the microprocessor for initiating the predetermined time delay prior to the emitting of the audio sound.

5 Claims, 5 Drawing Sheets

Strain Guage Transducer

Quartz or Ceramic Cartridge Transducer

Condenser Microphone

Golf Ball Strike Point Trigger Generator

Countdown Timer & Display

GOLF TIMER CONTROL

BACKGROUND OF THE INVENTION

1. Field of the Invention

The present invention relates to a golf timer control and more particularly pertains to a golfing aid to provide an audio signal indicating when a golfer may lift his or her head after hitting the ball.

2. Description of the Prior Art

The use of golf aids is known in the prior art. More specifically, golf aids heretofore devised and utilized for the purpose of improving performance are known to consist basically of familiar, expected and obvious structural configurations, notwithstanding the myriad of designs encompassed by the crowded prior art which have been developed for the fulfillment of countless objectives and requirements.

Prior art approaches for golfing aids including U.S. Pat. No. 5,005,835 to Huffman which relates to a golf swing head movement monitoring apparatus.

U.S. Pat. No. 4,819,942 to Lee discloses a golf swing indicator locatable adjacent the hozel.

U.S. Pat. No. 4,991,850 to Wilhlem discloses a golf swing evaluation system including mechanisms couplable to a wrist watch like element.

U.S. Pat. No. 5,042,814 to Bennett relates to an instructionable ball hitting device for golfers including repositionable pegs on a map.

In this respect, the golf timer control according to the present invention substantially departs from the conventional concepts and designs of the prior art, and in so doing provides an apparatus primarily developed for the purpose of providing a golfer with a signal as to when his or her head may be lifted after hitting a shot.

Therefore, it can be appreciated that there exists a continuing need for new and improved golf timer control which can be used to provide a signal when his or her head may be lifted after hitting the ball. In this regard, the present invention substantially fulfills this need.

SUMMARY OF THE INVENTION

In view of the foregoing disadvantages inherent in the known types of golfing aids now present in the prior art, the present invention provides an improved golf timer control. As such, the general purpose of the present invention, which will be described subsequently in greater detail, is to provide a new and improved golf timer control apparatus and method which has all the advantages of the prior art golf timer control and none of the disadvantages.

To attain this, the present invention essentially comprises a new and improved golfing aid to emit an audible signal to a golfer at a predetermined lapsed time after hitting a golf ball comprising, in combination, a grip positionable over the butt end of a golf club, the grip having a butt adapted to support a microphone and an end remote from the butt for supporting a microprocessor thereadjacent; a microphone located at the butt of the grip, the microphone adapted to detect the sound of a golf club hitting a golf ball and to generate a signal in response thereto; a microprocessor positioned in the grip at the end thereof remote from the butt and microphone, the microprocessor having an emitter for an audible sound, the emitter adapted to be energized at a predetermined lapsed time following the detection of the signal by the microphone; control means within the microprocessor to vary the predetermined lapsed time at the selection of the user and to display the preselected lapsed time; and lines coupling the microphone and microprocessor for transmitting the signal generated by the microphone to the microprocessor for initiating the predetermined time delay prior to the emitting of the audio sound.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golf timer control which has all the advantages of the prior art golfing aids and none of the disadvantages.

It is another object of the present invention to provide a new and improved golf timer control which may be easily and efficiently manufactured and marketed.

It is a further object of the present invention to provide a new and improved golf timer control which is of a durable and reliable construction.

An even further object of the present invention is to provide a new and improved golf timer control which is susceptible of a low cost of manufacture with regard to both materials and labor, and which accordingly is then susceptible of low prices of sale to the consuming public, thereby making such golf timer control economically available to the buying public.

Still yet another object of the present invention is to provide a new and improved golf timer control which provides in the apparatuses and methods of the prior art some of the advantages thereof, while simultaneously overcoming some of the disadvantages normally associated therewith.

Still another object of the present invention is to assist a golfer in improving his or her swing by generating a signal at a predetermined lapsed time after hitting a shot as an indicator that his or her head may be lifted.

Yet another object of the present invention is to generate a signal whereby a golfer may thereafter lift his or her head and thereby improve concentration, swing and score.

Even still another object of the present invention is to provide a new and improved golfing aid to emit an audible signal to a golfer at a predetermined lapsed time after hitting a golf ball comprising a microphone located at the butt end of a golf club grip, the microphone adapted to detect the sound of a golf club hitting a golf ball and to generate a signal in response thereto; a microprocessor positioned in the grip of a golf club at the end thereof remote from the butt and microphone, the microprocessor having an emitter for an audible sound, the emitter adapted to be energized at a predetermined lapsed time following the detection of the signal by the microphone; control means within the microprocessor to vary the predetermined lapsed time at the selection of the user and to display the preselected lapsed time; and lines coupling the microphone and microprocessor for transmitting the signal generated by the microphone to the microprocessor for initiating the predetermined time delay prior to the emitting of the audio sound.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
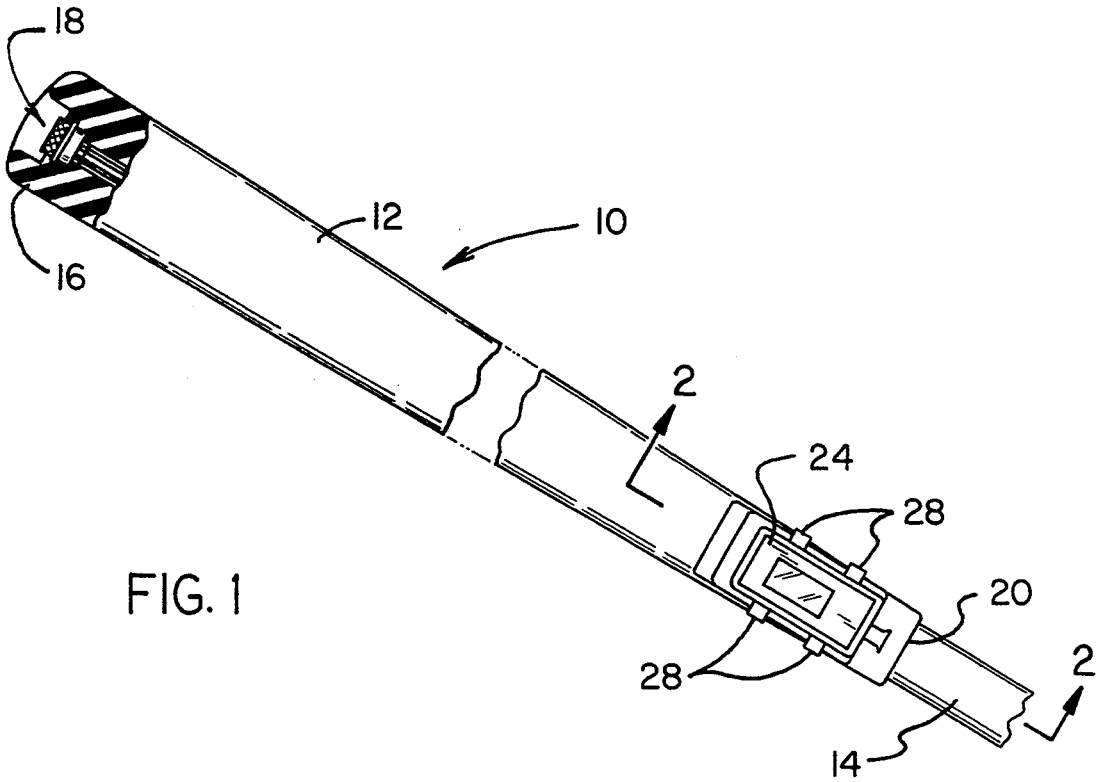
FIG. 1 is a perspective illustration of a golf timer control constructed in accordance with the principles of the present invention.
Figure 2:
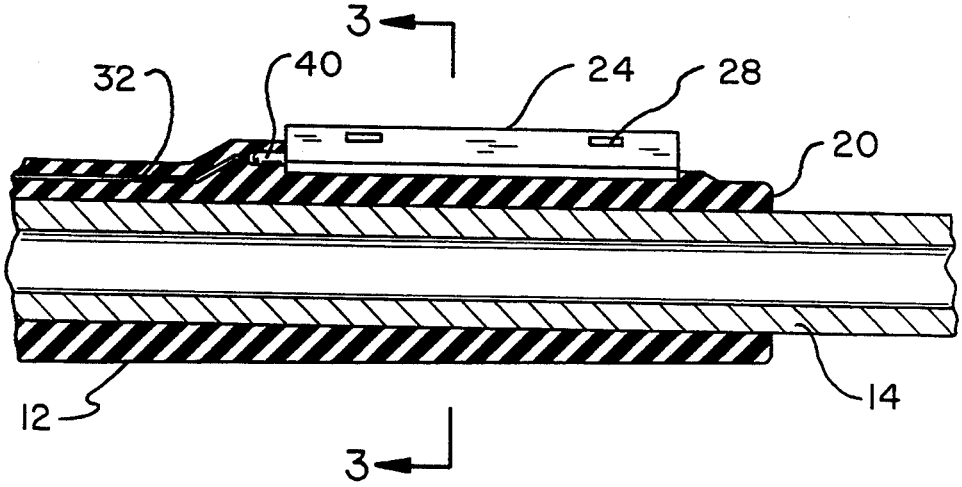
FIG. 2 is a sectional view taken along line 2—2 of FIG. 1.
Figure 3:
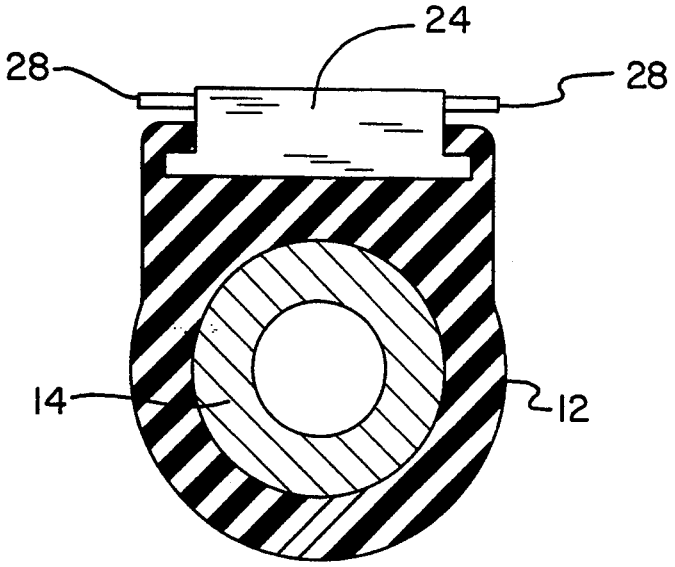
FIG. 3 is a sectional view taken along line 3—3 of FIG. 2.

With reference now to the drawings, and in particular to FIG. 1 thereof, a new and improved golf timer control embodying the principles and concepts of the present invention and generally designated by the reference numeral 10 will be described.

More specifically, it will be noted that the present invention relates to a new and improved golfing aid 10. The aid functions to emit an audible signal to a golfer at a predetermined lapsed time after hitting a golf ball. The device comprises a grip 12 positionable over the butt end of a golf club 14. The grip having a butt 16 which is adapted to support a microphone 18. The grip also has an end 20 remote from the butt end. Supported in the remote end 20 is a microprocessor 24.

The microphone 18 is located at the butt end of a golf club shaft and grip 12. It is adapted to detect the sound of a golf club hitting a golf ball and to generate a signal in response thereto.

The microprocessor 24 is positioned in the grip 12 of a golf club at the end 20 thereof remote from the butt 16 and microphone 18. The microprocessor has an emitter for an audible sound of a golf club hitting a ball. The emitter is adapted to be energized at a predetermined lapsed time following the generation of the signal by the microphone. Control means 28 including buttons associated with the microprocessor to vary the predetermined time at the selection of the user to display the preselected time. The buttons 28 also allow display of the preselected time and associated functions.

Lines 32 are provided for coupling the microphone 18 for transmitting the signal generated by the microphone to the microprocessor 24. This allows for initiating the predetermined time delay prior to the emitting of the audio sound.

The circuitry within the programmer 28 further including circuitry to effect a power down sleeper mode. In this manner, the power may shut down after a time of non-use.

Figure 4:
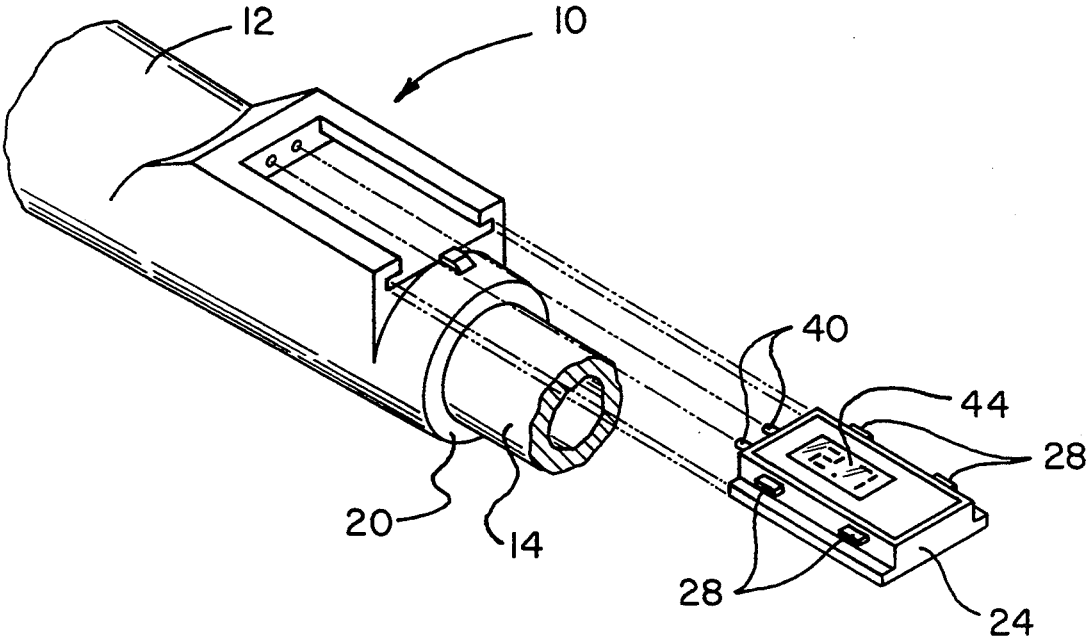
FIG. 4 is an exploded perspective view of the end of the grip remote from the butt showing the microprocessor removed.
Figure 5:
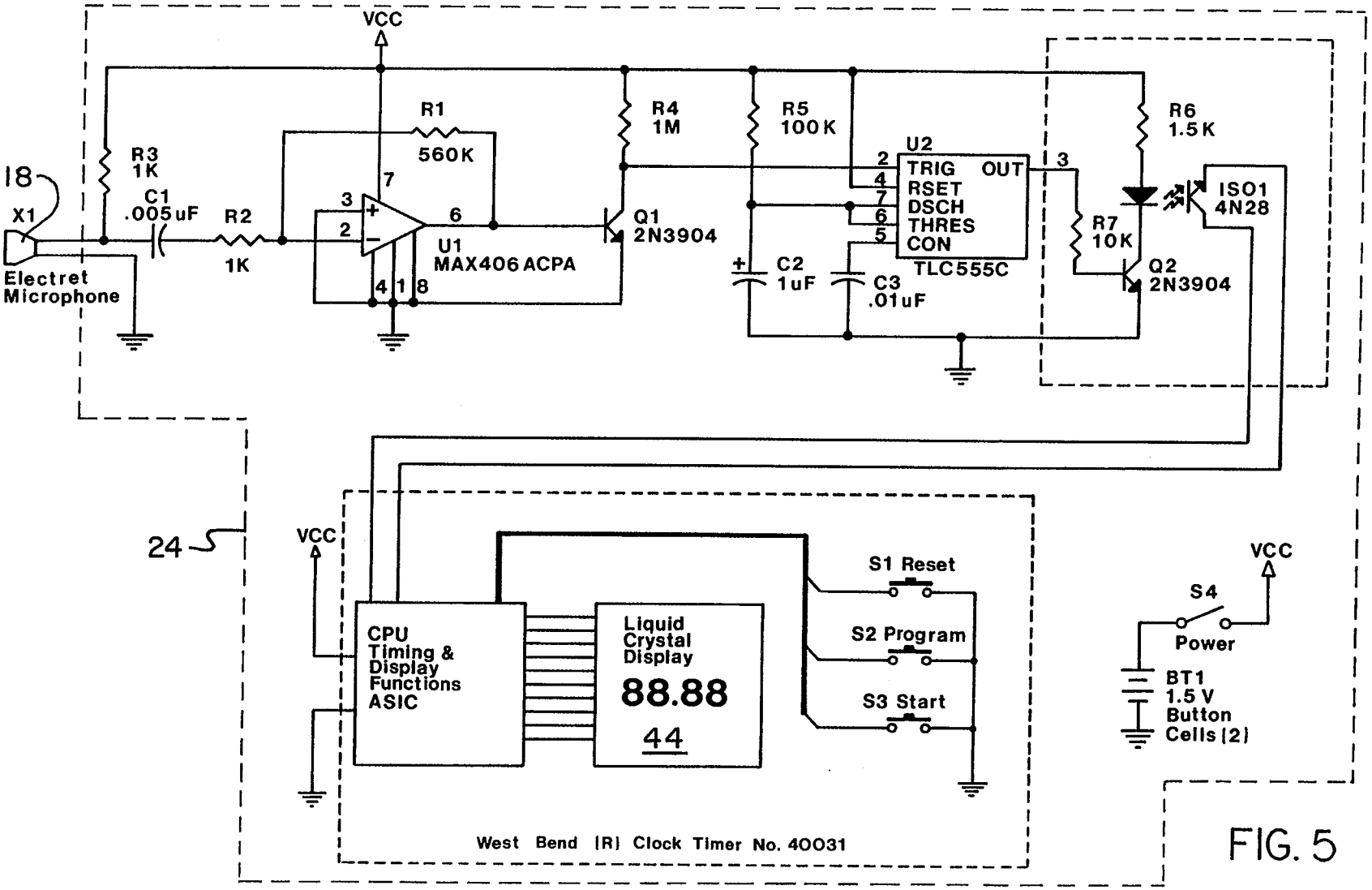
FIG. 5 is an electrical schematic of the electronics used in the microprocessor of the present invention.

The present invention features a modular format arranged longitudinally along a molded rubber golf grip which has a modified section for retaining the time and display electronics unit. This unit is packaged for friction fit into dual slots on the grip and utilizes a two pin connector 40 to interface with the electret microphone which is also molded into the grip. Note FIG. 4. The electrical schematic is shown in FIG. 5.

The invention is composed of an electronic circuit which senses the sound of clubhead contact with a golf ball which triggers a countdown timer and emits a beep at the end of a user specified lapsed time interval. It contains a transducer, trigger generator, timer microprocessor, liquid crystal display, tone output circuit and a power supply.

The power supply for this device can be a similar button cell or a photocell array capable of supplying the required current levels during normal operation.

Figure 6:
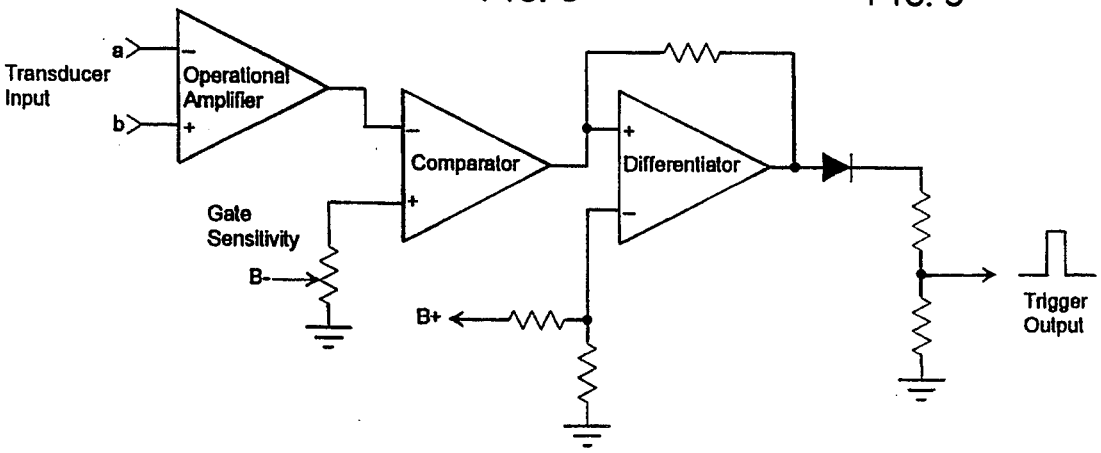
FIG. 6 is a functional diagram reflecting elements of the control timer.

The trigger generator consists of an amplifier and signal shaping circuits to take the input transducer signal and create a square wave trigger. Note FIG. 6. Three transducer configurations are depicted in FIGS.

Figure 7:
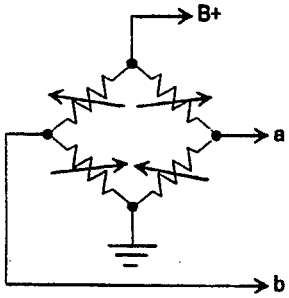
FIG. 7 illustrates one type of input to the control timer circuitry of FIG. 6.
Figure 8:
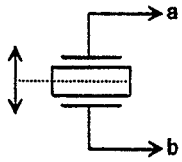
FIG. 8 illustrates another type of input to the central timer circuitry of FIG. 6.
Figure 9:
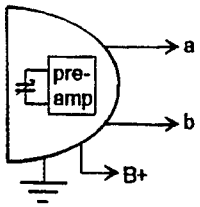
FIG. 9 illustrates yet another type of input to the control timer circuitry of FIG. 6.

7, 8, and 9. One of which is selected as the optimum for cost and ease of use such transducers include a strain gauge transducer of FIG. 7, a quartz or ceramic cartridge transducer of FIG. 8 and a condenser microphone of FIG. 9. A comparator is employed to minimize false triggering which can be adjusted using the sensitivity control.

Figure 10:
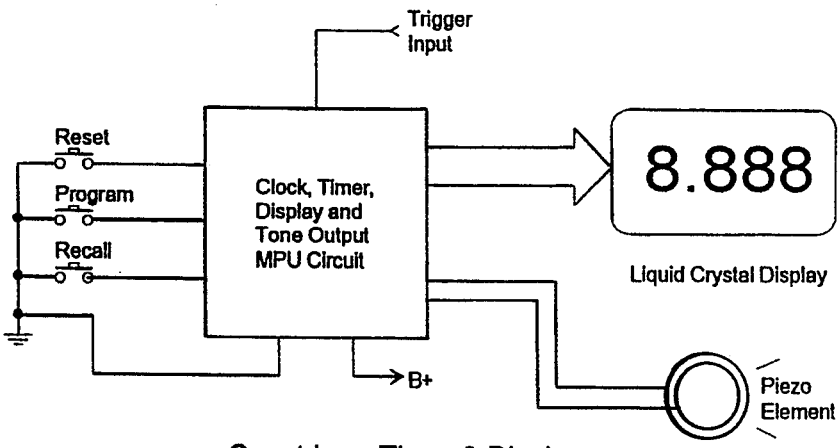
FIG. 10 is a functional diagram of the count down timer and display.

The timer MPU is an integrated circuit much the same as those utilized in wrist watches with reduced functionality. Note FIG. 10. Its program is limited to providing the countdown functions using reset, program and recall buttons along with the ball strike trigger generator. The reset button should provide a full reset of the device's operating conditions. The program button will allow the user to specify the time interval used in the countdown and should allow for stepping through increments of 10 milliseconds over a range of zero to five seconds. The recall button is provided to wake up the display as it is blanked during a "reduced power consumption" mode and should provide an output showing the last timer interval specified by the user. At the end of a timer countdown, the device will drive a tone generator circuit to deploy an audible tone via a piezo-electric element for a duration of about one second. The timer MPU will interface with a four digit liquid crystal display 44 for indication the timer interval during specification of such by the user.

Referring to FIG. 5, an electret microphone with a sensitivity of −70 dB at 5 KHZ provides initial amplification of the audio signal produced at clubhead impact. Resistor R3 supplies the microphone's internal amplifier with power and current limiting. The signal is then coupled to an operational amplifier, U1, through capacitor C1. C1 provides isolation of the supply voltage for the microphone's internal amplifier from the next stage of amplification and also limits the input frequency response which is optimized around 5 kilohertz.

The MAX406ACA operational amplifier, U1, provides a voltage gain on the order of 560 times determined by resistors R1 and R2 which form an inverting OP amp configuration. U1 actually over amplifies the audio signal and causes the output signal voltage to swing rail to rail producing a square wave output. This square wave is then fed to transistor Q1, which simply acts as a switch and provides inversion of the signal to produce a negative going trigger.

This trigger is used to start a low power CMOS TLC555 timer, U2. This 555 is configured as a "one-shot" and runs in monostable mode. Capacitor C3 provides a noise immunity for the 555 timer by providing a path to bypass noise accumulated on the power input line. Capacitor C2 and resistor R5 combine to form an RC time constant which determines the output gate signal generated by the timer. The values selected produce a gate width of 100 milliseconds. This wider gate signal was required to properly activate the West Bend model 40031 clock timer and start its countdown timing. The gate signal is emitted from pin 3 of U2 and then coupled through a current limiting resistor, R7, to switching transistor Q2. While the gate is active high, transistor Q2 becomes forward biased which allows the LED in opto-isolator ISO1 to light. This then causes the photo transistor inside the opto-isolator to lower its junction resistance and emulate a key press of the West Bend unit start button thereby starting the user specified timing cycle 4. The collector and emitter leads from the transistor in the opto-isolator are connected directly in parallel with the start button in the West Bend unit. The area defined by the dashed-line box of the schematic groups a number of components required to interface the West Bend unit which will not be required in a production model. The production model would incorporate an application specific integrated circuit (ASIC) containing the Head Down Timer Control's electronics coupled with essential portions of the West Bend unit.

Switches S1 through S3, depicted in the schematic, are used to provide programming and manual activation capability to the user and are already an integral part of the West Bend timer unit. They are a subset of the entire complement of buttons in the unit which comprise the required functions for the invention.

The schematic depicts the power supply and on/off switch. Power is derived from two button cells, which provide three volts to the rest of the circuitry. The entire circuit draws a quiescent operating current of approximately 350 micro amps excluding the West Bend timer unit. This should provide ample life for the button cells during normal operation.

The West Bend Timer unit already incorporates an ASIC, which contains more functionality than required to perform the intended objectives of the invention. This model draws a fraction of the current consumed by the electronics. Optimally, the entire circuit should draw only about 200 micro amps to provide extended battery life, an achievable objective. An ASIC which incorporates the basic functionality of the Head Down Timer Control circuit and essential functions within the West Bend timer unit, would reduce the overall part count to approximately 12 components total. This reduction in part count is essential to minimize the space consumed by the electronics, a limiting factor in attaining the mechanical design depicted.

The electret microphone, X1 on the schematic, is remotely located from the rest of the timer electronics and is molded into the rubber grip as depicted in the mechanical design. A mylar strip containing two lines of circuit trace would be suitable for coupling the microphone's output to the Head Down Timer Control circuit board and is also molded inside the rubber grip. It is terminated with two pin sockets which form a connector for the timer assembly to mate with.

The circuit design is subject to a number of revisions that can be applied to enhance performance or provide for equivalent functionality using other methods. One such enhancement is the incorporating of a power down "sleeper mode" where the circuit would draw even less current during idle periods and wake up on demand. Alternate methods of producing the initial input signal can be employed and should be considered before producing a production model. The method chosen to acquire the input signal through an audio microphone was selected based on availability and cost of suitable input transducers. Alternate transducers may provide better reliability and performance. Every attempt has been made to optimize the existing design to perform its intent without false triggering. The current design is relatively immune to false triggering from voices or other sources of audible sounds. The unit could start an erroneous count down cycle from clubs jostled in a golfer's bag if left on. This is another argument for the "sleeper mode" which could be incorporated.

Figure 11:
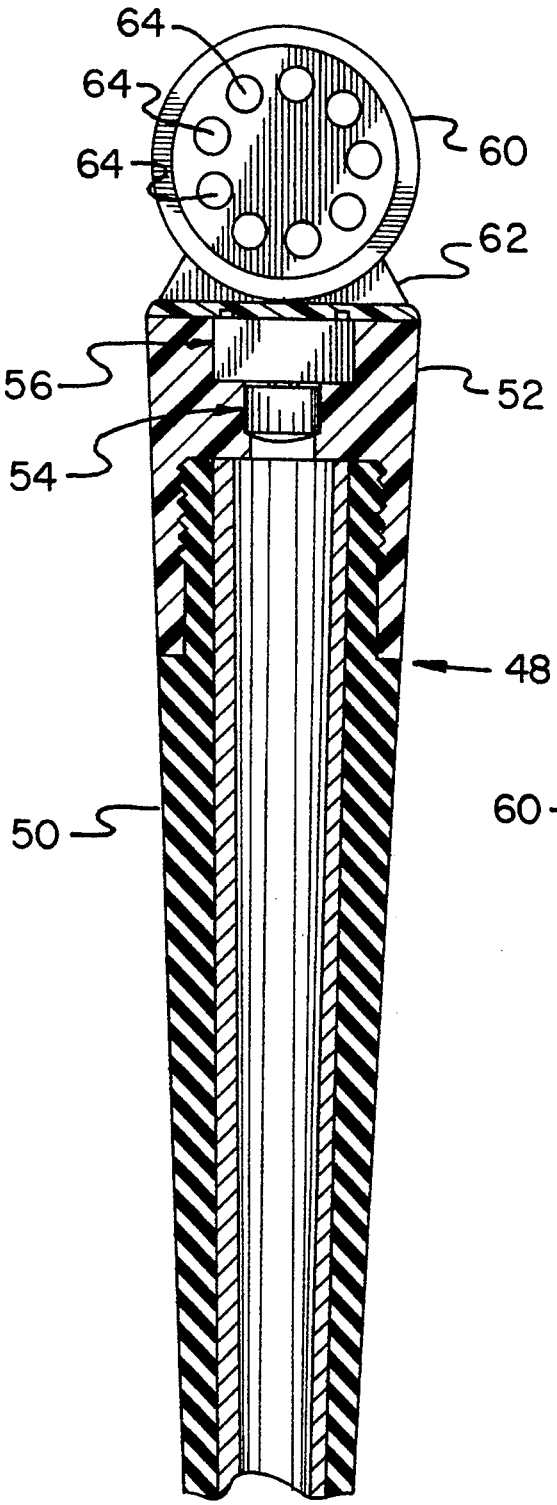
FIG. 11 is a sectional view of a handle constructed in accordance with an alternate embodiment of the invention.
Figure 12:
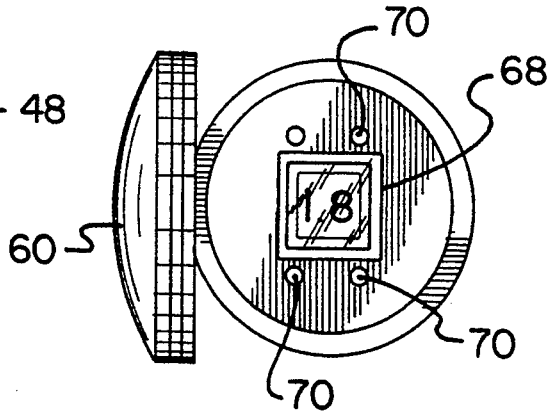
FIG. 12 is a top view of the handle shown in FIG. 11 with the cap in the open position.

Shown in FIGS. 11 and 12 is a modified grip constituting an alternate embodiment of the invention. The modified grip 48 is constructed of two components, an elongated section 50 located over the shaft 14 of the golf club and an end piece 52 of a shortened length positioned at the end of the shaft 14. The elongated section 50 and end piece 52 are separable and couplable by mating screw threads therebetween.

Located within the end piece 52 are the functioning components of the system. Such components include the microphone 54 and microprocessor 56 as well as the associated control means. A snap closure cap 60 is coupled to the end piece 52 through a plastic living hinge 22. The cap is movable between an open position as shown in FIGS. 11 and 12 to expose the microprocessor and related components and a closed position to shield such components. Apertures 64 are formed in the cap 60 for air flow and drainage.

Also formed as part of the microprocessor 56 are the display 68 and programming buttons 70. Such components function in an analogous manner to components 24 and 28 of the embodiment shown in FIG. 1 and described in respect thereto. FIG. 12 shows such components exposed for display and reprogramming with the cap open. Access thereto is precluded when the cap 60 is closed in which orientation the grip has the appearance of a conventional grip.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved golfing aid to emit an audible signal to a golfer at a predetermined lapsed time after hitting a golf ball comprising, in combination:

a grip positionable over the butt end of a golf club, the grip having a butt adapted to support a microphone and an end remote from the butt for supporting a microprocessor thereadjacent;

a microphone located at the butt of the grip, the microphone adapted to detect the sound of a golf club hitting a golf ball and to generate a signal in response thereto;

a microprocessor positioned in the grip at the end thereof remote from the butt and microphone, the microprocessor having an emitter for an audible sound, the emitter adapted to be energized at a predetermined lapsed time following the detection of the signal by the microphone;

control means within the microprocessor to vary the predetermined lapsed time at the selection of the user and to display the preselected lapsed time; and lines coupling the microphone and microprocessor for transmitting the signal generated by the microphone to the microprocessor for initiating the predetermined time delay prior to the emitting of the audio sound.

2. A golfing aid to emit an audible signal to a golfer at a predetermined lapsed time after hitting a golf ball comprising:

a microphone located at the butt end of a golf club grip, the microphone adapted to detect the sound of a golf club hitting a golf ball and to generate a signal in response thereto;

a microprocessor positioned in the grip of a golf club at the end thereof remote from the butt and microphone, the microprocessor having an emitter for an audible sound, the emitter adapted to be energized at a predetermined lapsed time following the detection of the signal by the microphone;

control means within the microprocessor to vary the predetermined lapsed time at the selection of the user and to display the preselected lapsed time; and lines coupling the microphone and microprocessor for transmitting the signal generated by the microphone to the microprocessor for initiating the predetermined time delay prior to the emitting of the audio sound.

3. The apparatus as set forth in claim 2 and further including circuitry to effect a power down sleeper mode.

4. The apparatus as set forth in claim 2 wherein the grip is fabricated of two matable sections, an elongated section located over the shaft of the golf club and an end piece for supporting the microphone, microprocessor and control means and also a display device with programming buttons.

5. The apparatus as set forth in claim 2 wherein the end piece of the grip includes a snap closure cap movable between an open position to expose the display device and programming buttons and a closed position to shield the display device and programming buttons.

* * * * *